United States Patent [19]

Grosko

[11] 4,316,561

[45] Feb. 23, 1982

[54] POUR TUBE LATCHING APPARATUS

[75] Inventor: John A. Grosko, South Park Township, Allegheny County, Pa.

[73] Assignee: United States Steel Corporation, Pittsburgh, Pa.

[21] Appl. No.: 175,469

[22] Filed: Aug. 5, 1980

[51] Int. Cl.[3] ..... B22D 41/08

[52] U.S. Cl. ..... 222/606; 222/607; 164/337

[58] Field of Search ..... 164/337, 437; 222/82, 222/590, 591, 600, 606, 607, 533, 536, 537, 601

[56] References Cited

U.S. PATENT DOCUMENTS

| | | | |
|---|---|---|---|
| 2,143,758 | 1/1939 | Bröms | 222/607 |
| 3,861,571 | 1/1975 | Franklin | 222/533 |
| 3,884,400 | 5/1975 | Tuschak et al. | 222/600 X |
| 3,907,022 | 9/1975 | Simons et al. | 222/606 X |
| 4,079,869 | 3/1978 | Meier et al. | 222/607 X |
| 4,091,861 | 5/1978 | Thalmann et al. | 222/607 X |
| 4,131,220 | 12/1978 | Bode, Jr. et al. | 222/607 |
| 4,222,505 | 9/1980 | Daussan et al. | 222/600 |
| 4,262,827 | 4/1981 | De Masi et al. | 164/337 X |
| 4,275,825 | 6/1981 | King et al. | 222/606 X |

FOREIGN PATENT DOCUMENTS

| | | | |
|---|---|---|---|
| 2621557 | 4/1977 | Fed. Rep. of Germany | 222/607 |
| 1157818 | 7/1969 | United Kingdom | 222/607 |
| 502705 | 4/1976 | U.S.S.R. | 222/607 |

*Primary Examiner*—David A. Scherbel
*Attorney, Agent, or Firm*—John F. Carney

[57] ABSTRACT

Apparatus is described for attaching a shroud tube to the pour nozzle of a sliding gate valve, or the like, from a remote position. The apparatus is also effective to impart compound movement to the shroud tube for inserting the end of the tube into the opening in a tundish cover. Apparatus according to the invention is characterized by simplicity of design, low capital cost and ease of manipulation.

18 Claims, 10 Drawing Figures

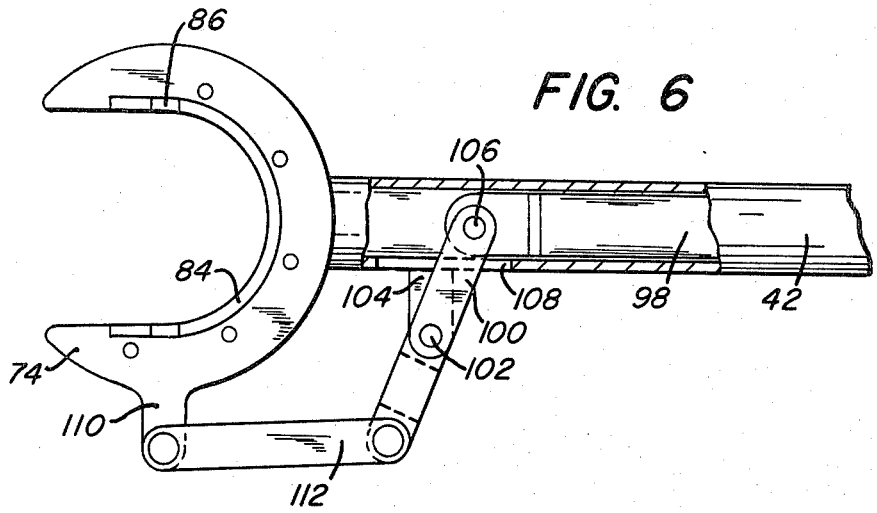
FIG. 6
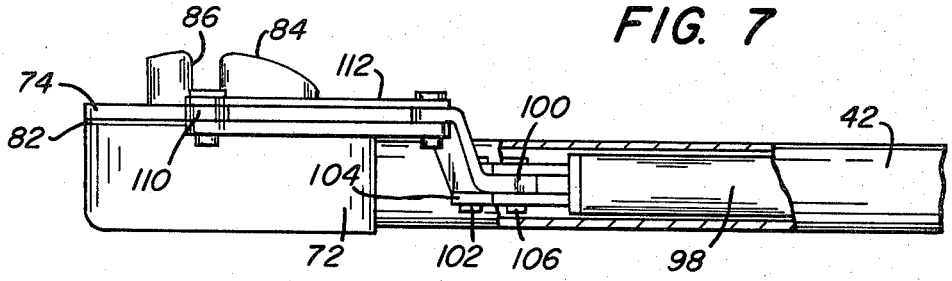
FIG. 7
FIG. 8
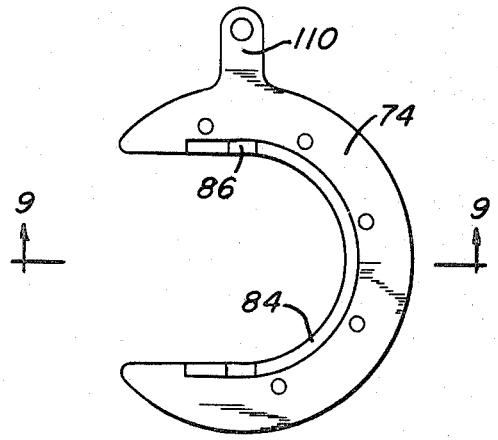
FIG. 10
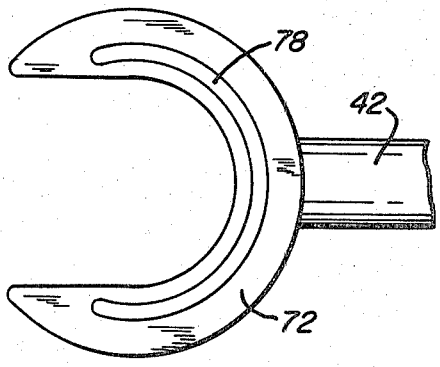
FIG. 9
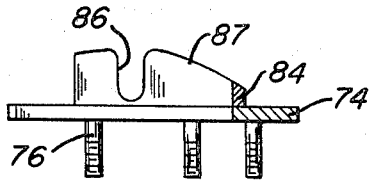

POUR TUBE LATCHING APPARATUS

BACKGROUND

This invention relates to improved apparatus for manipulating from a remote location a shroud tube that encloses the molten stream flowing from a bottom pour teeming vessel to a receiver, such as a tundish. More particularly, the invention involves a manipulator of simple, light-weight construction that can be operated by a single workman from a remote location for connecting the inlet end of a shroud tube to the discharge nozzle from a teeming vessel. The apparatus is also for imparting the compound movements necessary to extend the discharge end of the shroud tube through the limited access opening of a tundish cover.

It is desirable when pouring molten metal of certain compositions, such as aluminum-killed steels, to prevent contact of the metal with ambient air in order to protect against reoxidation of the metal. Receivers for such metals are, accordingly, usually provided with a closure cover containing an access opening of limited dimensions and shroud tubes are commonly provided to enclose the molten stream from the teeming vessel to the receiver.

Shroud tubes for such service are formed of refractory material that is subject to erosion and wear, and therefore the tubes must be periodically replaced, oftentimes, before the teeming vessel has been emptied. In such instances, it had been the practice to terminate the pour whereupon one or more workmen would manually remove the spent tube and install a new one, a practice that is both arduous and hazardous.

In U.S. Pat. No. 4,131,220, granted Dec. 26, 1978 to Bode et al and assigned to the assignee herein, there is shown and described a manipulator for shroud tubes that enables the replacement of spent pour tubes from a remote location. While such apparatus is effective for the purpose intended, it is unduly bulky in size and of complicated design. This apparatus, moreover, incorporates numerous hydraulic operators that not only add to the capital cost of the apparatus but also require ancillary sources of hydraulic power that increase the cost of operation.

It is to the improvement of such apparatus, therefore, that the present invention is directed.

SUMMARY

According to the present invention, there is provided apparatus for mounting a shroud tube in operative relation to the pour opening in a bottom-pour teeming vessel which apparatus comprises a stationary base; a pivot saddle mounted on the base for rotation about a vertical axis thereof; open-ended journal means pivotally mounted to the saddle; an elongated arm received in the journal means and supported therein for axial and rotatable movement; means at the end of the arm for vertically suspending a shroud tube, such means including means for rotating the shroud tube about its longitudinal axis; means at the other end of the arm for manually moving the arm with respect to the journal means; and means operable from the other end of the arm for actuating the shroud tube rotating means.

It is therefore a principle object of the present invention to provide improved apparatus of simple, low-cost design for effectively connecting from a remote location a shroud tube to the pour nozzle of a bottom pour teeming vessel.

It is another object of the invention to provide apparatus of the described type that permits removal and replacement of shroud tubes with respect to the pour opening of a bottom-pour teeming vessel without disturbing other parts of the assembly and without danger to the workman.

A further object of the invention is to provide apparatus of the described type that permits operation thereof with movable discharge nozzles of sliding gate valves, or the like.

A still further object of the invention is to provide apparatus that permits ready removal and replacement of shroud tubes within the confined space between a bottom-pour teeming vessel and a closely subjacent receiver.

For a better understanding of the invention, its operating advantages and the specific objectives obtained by its use, reference should be made to the accompanying drawings and description which relate to a preferred embodiment thereof.

BRIEF DESCRIPTION OF THE DRAWINGS

FIG. 6 is a partial plan view, partly in section, illustrating the movable support and operating linkage incorporated in the invention;

FIG. 7 is an elevational representation of the movable support and operating linkage shown in FIG. 6;

FIGS. 8 and 9 are plan and side views, respectively, of the movable support; and FIG. 10 is a plan view of the vertical support member of the apparatus.

DESCRIPTION OF A PREFERRED EMBODIMENT OF THE INVENTION

Figure 1:
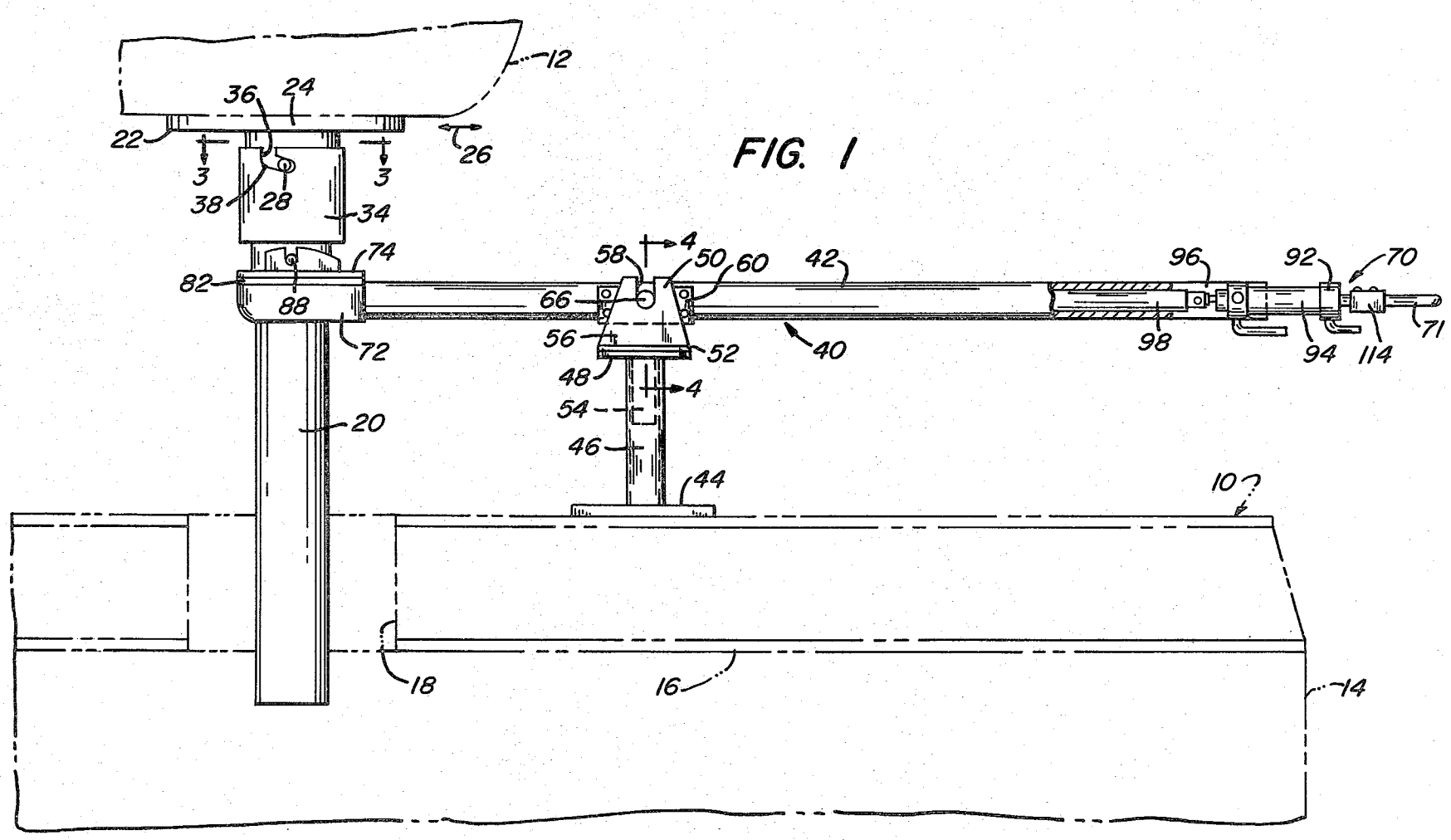
FIG. 1 is an elevational view of the apparatus of the present invention operatively positioned between a bottom-pour teeming ladle and a tundish.
Figure 2:
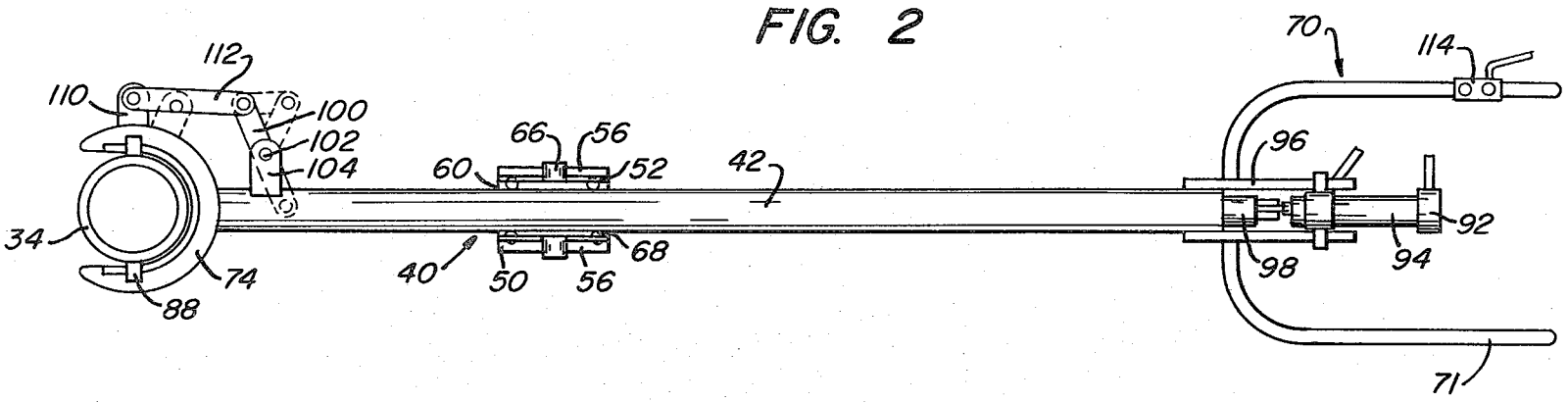
FIG. 2 is a plan view of the apparatus of FIG. 1.

In the drawings there is partly shown a receiving vessel, such as a tundish 10, in operative position beneath a bottom-pour teeming vessel 12. The tundish 10 includes an elongated, refractory-lined shell 14 having an upper end closed by refractory-lined cover 16. The cover 16 contains a centrally-disposed opening 18 to permit passage of a shroud tube 20. The teeming vessel 12, only part of which is shown, is a conventional ladle provided at its bottom end with a sliding gate valve 22 of known construction having a depending pour nozzle 24 that is movable in the direction of the arrow 26 to control the flow of molten metal from the ladle to the tundish. A sliding gate valve of the type shown at 22 is disclosed in detail in U.S. Pat. No. 4,063,668 granted Dec. 20, 1977 to E. P. Shapland, et al and will be described herein only to the extent necessary for an understanding of the present invention.

As shown in several of the figures, the pour nozzle 24 is provided with a pair of diametrally opposed, radially extending pins 28 that serve to attach the shroud tube 20, the latter extending from the pour nozzle into the interior of the tundish 10 in order to prevent reoxidation of the flowing metal by protecting it against contact with ambient air. The shroud tube 20 is of conventional design being formed of an elongated, generally cylindrical hollow body having at its upper end an enlarged head 30 forming a downwardly facing shoulder 32.

Figure 5:
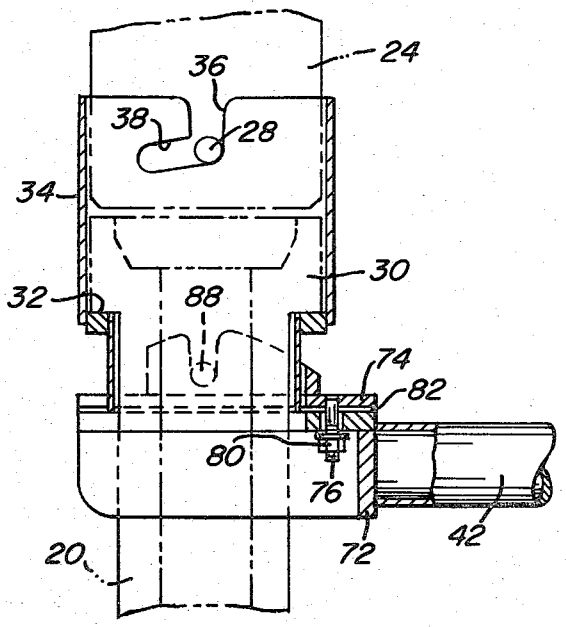
FIG. 5 is a partial elevational view taken through the shroud tube holder of the present invention.
Figure 3:
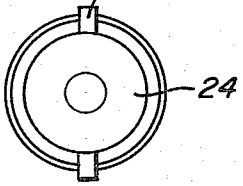
FIG. 3 is a sectional view taken along line 3—3 of FIG. 1.

In accordance with the invention, there is provided an adapter 34 formed as a generally cylindrical open-ended body sized to freely receive the shroud tube head 30 which engages the adapter at the shoulder 32. The upper end of the adapter is provided with a pair of diametrally opposed bayonet slots 36 engageable with the pins 28 to attach the adapter with the retained shroud tube 20 to the pour nozzle 24 upon rotation of the adapter in a clockwise direction, as hereinafter described. As shown in FIGS. 1 and 5, the lower legs of the slots 36, indicated as 38, are inclined in a direction to impart an upward movement to the shroud tube 20 in order to bring it into sealed, seated engagement with the lower end of the nozzle 24 when the adapter is rotated clockwise.

Apparatus for attaching the shroud tube 20 to the pour nozzle 24 and for manipulating the tube for insertion of its lower end through the opening 18 in tundish cover 16 from a remote location is indicated generally as 40. In general, it comprises an elongated arm 42 containing mechanism at one end for manipulating the shroud tube 20 through the movements necessary to produce the desired result and means at the other end for manually operating the manipulating means. Specifically, the apparatus includes a base 44 here shown as being mounted on the tundish cover 16 but which may be more desirably mounted elsewhere in a fixed location. The base 44 includes a hollow, upstanding post 46 and a horizontal platform 48 having an opening aligned with the interior of the post. A pivot saddle 50 is rotatably mounted on the base, comprising a bottom plate 52 that rests on the platform 48 and a pin 54 depending from the plate 52 that is telescopically received in the post 46 for rotation therein. Attached to the bottom plate 52 are a pair of upstanding plates 56, the upper ends of which contain pivot slots 58 that operate to pivotally mount a journal bearing 60 that mounts the arm 42 for axial and rotational movement.

Figure 4:
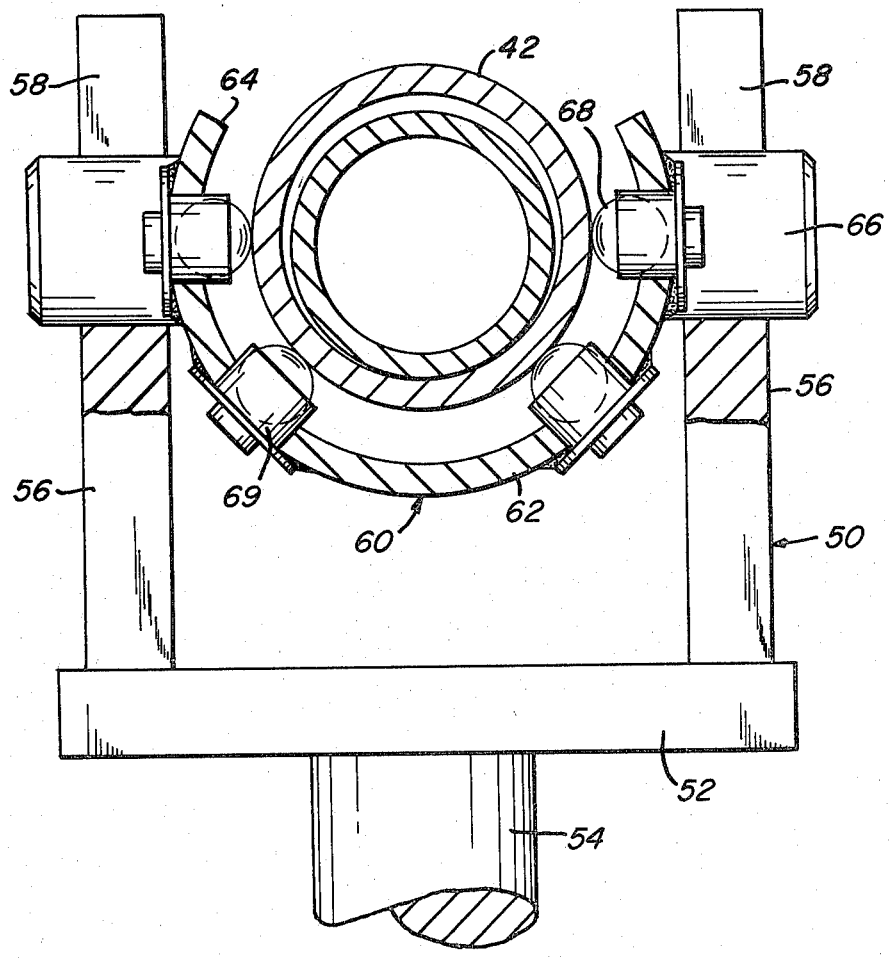
FIG. 4 is a sectional view taken along line 4—4 of FIG. 1.

The journal bearing 60 is best shown in FIG. 4 and comprises an arcuate base 62 formed as a section of a cylinder having an upwardly facing opening 64 to facilitate assembly of the arm 42 therein. A pair of diametrally opposed pins 66 extend outwardly from the midpoint of the base 62 and operate to mount the member 60 in the slots 58 for pivotal movement about its lateral axis. The arm 42 is supported in the journal bearing 60 upon roller bearings 68 disposed in fixed receptacles 69 that are circumferentially spaced about the base 62 adjacent opposite ends thereof.

The arm 42 of the apparatus is an elongated tubular member which, as shown in FIG. 1, rests in the journal bearing 60 and extends from a location subjacent the pour nozzle 24 to a point remote from the ladle 12. At the operating end of the arm 42, indicated generally as 70, there are provided oppositely extending operating handles 71 to permit a workman to manually operate the apparatus. The other end of the arm 42 has fixed thereto a support yoke 72 that is open at its end to permit attachment and detachment of a shroud tube 20. A generally C-chaped tube support plate 74 rests on the upper surface of the support yoke 72, its side opening conforming substantially with that of the opening in the yoke 72. The plate 74 is adapted for rotational movement upon the yoke 72 about an axis substantially coincident with the longitudinal axis of the shroud tube 20 when mounted thereon. The path of movement of the plate 74 is guided by the cooperation between a plurality of pins 76 depending from the lower surface of the plate and an arcuate slot 78 formed in the upwardly facing surface of the yoke 72. The ends of the pins 76 are desirably threaded for reception of nuts 80 that serve to retain the plate 74 in attached relation to the yoke 72. Movement between the plate 74 and the yoke 72 can be facilitated by interposition of a lubricated shim 82, or the like, between the plate and the yoke.

The tube support plate 74 contains an integrally formed, upstanding, arcuate wall 84 containing a pair of diametrally spaced slots 86 for reception of pins 88 that extend radially from the lower end of the shroud adapter 34 thereby serving to mount the adapter and its retained shroud tube for pivotal movement about a horizontal axis upon the support plate 74. In this regard, the upper edge of the wall 84 may be provided with an arcuately formed depression 86 at its rear end to accommodate rocking movement of the shroud tube head. It will be appreciated that mounting the adapter 34 upon the support plate 74 in this manner, not only permits pivotal adjustment of the shroud tube to facilitate reception of the pour nozzle pins 28 in the bayonet slots 36 in the adapter 34 but also serves as the means for retaining the shroud tube 20 on the arm 42 as well as for imparting the rotational movement to the adapter 34 necessary to effect connection of the shroud tube to the pour nozzle 24.

Rotational movement of the plate 74 upon the yoke 72 is effected from the operating end 70 of the arm 42 by means of a fluid operated motor 92 including a cylinder 94 that is pivotally mounted in brackets 96 attached to the arm 42 within easy access to the workman. The piston operated within the cylinder 94 is connected via an elongated connecting rod 98 that is concentrically disposed within the interior of the tube 42. At its opposite end, the connecting rod attaches to a lever 100 pivotally mounted to the arm 42 by a pivot pin 102 retained in a clevis 104. The lever 100 is pin-connected at 106 to the connecting rod 98, access thereto being provided by an opening 108 provided in the wall of the tube 42. The other end of the lever 100 is connected to a finger 110 in the tube support plate by an articulated link 112. To accommodate the relative spacing between the connecting rod 98 and the finger 110, the lever 100 is conveniently offset as shown in FIG. 7.

Actuation of the fluid motor 92 is effected by a controller 114 that may be a hand-held pendant or, as shown, attached to the handles 71. The controller 114 contains switches to actuate the cylinder 94 to produce a forward and a retracted movement of the connecting rod 98. In the described apparatus, the connecting rod 98 is arranged to have a throw of approximately three inches which will produce a rotational movement in the tube support plate 74 of about twenty-two degrees. Movement of the connecting rod 94 in the forward direction will effect the clockwise rotation of the plate 74 required for engaging the bayonet connection between the adapter 34 and the pour nozzle 24. Conversely, retraction of the connecting rod 98 rotates the plate 74 in a counter-clockwise direction to disengage the bayonet connection.

The operation of the hereindescribed apparatus is as follows. With the slide gate valve 22 on the teeming vessel 12 in its closed position, the arm 42 of the apparatus 40 is manually retracted by the operator to its rearwardmost position in the journal bearing 60 and rotated about its vertical axis to place the yoke 72 and tube support plate 74 in an exposed position to receive a shroud tube 20 having the adapter 34 assembled thereon. Where, as in the illustrated arrangement, insufficient vertical spacing is available to permit the shroud tube 34 to be positioned in a vertical attitude in the yoke 72, the arm 42 is rotated about its horizontal axis within the journal bearing 60 to place the yoke and tube support plate in a position to receive the shroud tube 20 in an inclined attitude. The shroud tube 20 is thus assembled in the yoke 72 by positioning the adapter pins 88 in the slots 86 formed in the upstanding wall 84 of the tube support plate 74. The shroud tube 20 is held in its inclined position and the arm 42 rotated to move the tube to a position beneath the exposed pour nozzle 24. In moving the shroud tube 20 to its position beneath the pour nozzle the arm 42 is rotated about its horizontal axis to insert the lower end of the tube 20 through the opening 18 in the tundish cover 16 and into a vertical attitude. If required, the operating end 70 of the arm 42 can be raised through pivoting of the journal bearing 60 in the saddle 50 to lower the shroud tube 20 to a position spaced below the pour nozzle after which the shroud tube can be pivotally raised into a position whereby the pour nozzle 24 enters the adapter 34 and the pins 28 on the former enter the bayonet slots 36 on the latter. Following this the operator actuates controller 114 operating the fluid motor 92 to move the connecting rod 98 forwardly whereupon the tube support plate 74 is rotated clockwise to engage the bayonet connection between the pour nozzle 24 and adapter 34. It will be appreciated that, due to the inclination of the lower legs 38 of the slots 36, the head 30 of the shroud tube 20 will, as shown in FIG. 5, be brought into fluid tight engagement with the lower end of the nozzle.

The apparatus 40 may thereafter be disconnected from the shroud tube 20 by raising the operating end 70 of the arm 42 to lower the yoke 72 and tube support plate 74 and disengage the pins 88 from the slots 86. Fluid motor 92 is then actuated to retract the connecting rod 98 and rotate the tube support plate 74 counterclockwise to its original position in alignment with the yoke 72 whereupon the arm can be axially retracted in the journal bearing 60 and thence rotated to an out-of-the-way position to permit teeming to commence by the opening of the gate valve 22.

The described apparatus 40 is operable to disconnect a spent shroud tube 20 from the pour nozzle 24 by simply reversing the procedural steps described above.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. Apparatus for mounting a shroud tube in operative relation to the pour opening in a bottom-pour teeming vessel comprising:

(a) a stationary base;

(b) a pivot saddle mounted on said base for rotation about a vertical axis thereof;

(c) open-ended journal means pivotally mounted to said saddle;

(d) an elongated arm received in said journal means and supported therein for axial and rotatable movement;

(e) means at one end of said arm for vertically suspending a shroud tube, said means including means for rotating said shroud tube about its longitudinal axis;

(f) means at the other end of said arm for manually moving said arm with respect to said journal means; and (g) means operable from said other end of said arm for actuating said shroud tube rotating means.

2. Apparatus according to claim 1 in which said shroud tube suspending means comprises:

(a) a support member fixed to said arm, said member being open at the end for reception of a shroud tube therein;

(b) a plate mounted on said support member for movement in the plane of said support member;

(c) means on said plate for supportively engaging a shroud tube; and (d) means for operatively connecting said plate to said actuating means.

3. Apparatus according to claim 2 in which said plate includes means for pivotally mounting said shroud tube thereon.

4. Apparatus according to claim 2 in which said plate contains an open end coincident with that on said support member.

5. Apparatus according to claim 4 in which said support member and said plate contain cooperating guide means for imparting rotational movement to said plate with respect to said support member.

6. Apparatus according to claim 5 in which said guide means comprises:

(a) an arcuate slot formed in said support member; and (b) a plurality of circumferentially spaced pins depending from the underside of said plate and received in said slot.

7. Apparatus according to claim 6 including nut means threadedly connected to said pins to prevent relative axial movement between said plate and said support member.

8. Apparatus according to claim 4 in which said actuating means comprises:

(a) a lever pivotally attached to said arm;

(b) articulated link means connecting one end of said lever to said plate;

(c) a fluid motor actuable from said other end of said arm; and (d) a connecting rod from said fluid motor operatively connected to the other end of said lever.

9. Apparatus according to claim 8 in which said arm is hollow and said connecting rod is telescopically movable therein.

10. Apparatus for teeming molten metal from a bottom-pour teeming vessel into a receiver longitudinally spaced from said teeming vessel comprising, in combination:

(a) a pour nozzle depending from said teeming vessel;

(b) an elongated shroud tube extending between said pour nozzle and said receiver;

(c) means for connecting one end of said shroud tube to said pour nozzle upon rotation of said shroud tube with respect thereto;

(d) apparatus for effecting the connection between said shroud tube and said pour nozzle including:

(i) a stationary base laterally spaced from said pour nozzle;

(ii) a pivot saddle mounted in said base for rotation about a vertical axis therein;

(iii) open ended journal means pivotally mounted in said saddle;

(iv) an elongated arm received at an intermediate point along its length in said journal means for axial and rotational movement therein said arm having one end positionable beneath said pour nozzle;

(v) means at said one end of said arm for vertically suspending said shroud tube and for rotating said shroud tube with respect to said pour nozzle;

(vi) means at the other end of said arm for moving said arm with respect to said journal means to locate said one end of said shroud tube with respect to said pour nozzle; and (vii) means operable from said other end of said arm for actuating said shroud tube rotating means.

11. Apparatus according to claim 10 in which said shroud tube suspending means comprises:

(a) a member fixed to said one end of said arm and sized to suspendingly receive said shroud tube, said member being open at the end to permit lateral movement between said member and said shroud tube;

(b) a plate mounted on said support member for rotational movement in the plane thereof;

(c) means on said plate for supportively engaging said shroud tube; and (d) means for operatively connecting said plate to said actuating means.

12. Apparatus according to claim 11 in which said plate contains an open end coincident with that on said support member.

13. Apparatus according to claim 12 in which said support member and said plate contain cooperating guide means for imparting rotational movement to said plate with respect to said support member.

14. Apparatus according to claim 13 in which said guide means comprises:

(a) an arcuate slot formed in said support member; and (b) a plurality of circumferentially spaced pins depending from the underside of said plate and received in said slot.

15. Apparatus according to claim 13 in which said actuating means comprises:

(a) a lever pivotally attached to said arm;

(b) articulated link means connecting one end of said lever to said plate;

(c) a fluid motor actuable from said other end of said arm; and (d) a connecting rod from said fluid motor operatively connected to the other end of said lever.

16. Apparatus according to claim 15 in which said arm is hollow and said connecting rod is telescopically movable therein.

17. Apparatus according to claim 15 in which said pour nozzle contains radially extending pin means and including a shroud tube adapter receiving said one end of said shroud tube, said adapter containing bayonet slot means for engagement with said pour nozzle pin means and means for connecting said adapter to said plate for rotation therewith.

18. Apparatus according to claim 17 in which said adapter connecting means comprises:

(a) diametrally spaced pins extending radially from the lower end of said adapter; and (b) pivot slots on said plate for receiving said pins.

* * * * *